United States Patent [19]

Achleitner et al.

[11] Patent Number: 4,951,633

[45] Date of Patent: Aug. 28, 1990

[54] HOT START METHOD FOR A COMBUSTION ENGINE

[75] Inventors: Erwin Achleitner, Regensburg; Gerald Weber, Sinzing, both of Fed. Rep. of Germany

[73] Assignee: Siemens Aktiengesellschaft, Berlin and Munich, Fed. Rep. of Germany

[21] Appl. No.: 416,994

[22] Filed: Oct. 2, 1989

[30] Foreign Application Priority Data

Oct. 28, 1988 [EP] European Pat. Off. ..... 88118031.9

[51] Int. Cl.[5] ..... F02D 41/06; F02N 17/08

[52] U.S. Cl. ..... 123/491; 123/179 L

[58] Field of Search ..... 123/179 G, 179 L, 478, 123/480, 491

[56] References Cited

U.S. PATENT DOCUMENTS

| | | | |
|---|---|---|---|
| 4,027,641 | 6/1977 | Moder | 123/491 X |
| 4,224,913 | 9/1980 | Barnard | 123/440 |
| 4,499,879 | 2/1985 | Stoltman et al. | 123/480 |
| 4,528,963 | 7/1985 | Bessho et al. | 123/491 |
| 4,723,523 | 2/1988 | Kataoka et al. | 123/491 |
| 4,747,386 | 5/1988 | Onishi | 123/491 |
| 4,770,148 | 9/1988 | Hibino et al. | 123/491 |
| 4,773,378 | 9/1988 | Fujimura et al. | 123/491 |

FOREIGN PATENT DOCUMENTS

| | | | |
|---|---|---|---|
| DT2410090 | 9/1975 | Fed. Rep. of Germany . | |
| 556-154133 | 11/1981 | Japan | 123/491 |

*Primary Examiner*—Willis R. Wolfe

*Attorney, Agent, or Firm*—Hill, Van Santen, Steadman & Simpson

[57] ABSTRACT

A method for carrying out a hot start in an internal combustion engine has a hot start condition that is recognized on the basis of the coolant temperature and the intake air temperature. A hot start identifier is stored when the coolant temperature and the intake air temperature have both reached a predetermined limit value at least once during a post-operation time after the internal combustion engine is turned off. At the next start of the internal combustion engine, the hot start is then carried out when the hot start identifier is stored and the coolant temperature still lies above its limit value. The method is thus based on temperature sensors that are already present in the motor control system. Therefore, no additional temperature sensors, for measuring the temperature of the fuel, are required.

7 Claims, 2 Drawing Sheets

HOT START METHOD FOR A COMBUSTION ENGINE

BACKGROUND OF THE INVENTION

1. Field of the Invention

The invention relates generally to a method for a hot start in a combustion engine. Such a method is disclosed in German OS No. 24 10 090.

2. Description of the Prior Art

In known engines, a hot start condition is recognized by the temperature of the coolant. It has been shown, however, that the coolant temperature by itself is not a reliable criterion for a hot start condition. It is therefore known to measure the temperature of the fuel with an additional temperature sensor. Although this method is exact, it requires an additional temperature sensor. Conventional methods for a hot start are thus involved and require considerable cost for additional sensors.

SUMMARY OF THE INVENTION

An object of the present invention is to recognize accurately a hot start condition with reliability without the use of additional temperature sensors.

The above object is achieved in a method executed in accordance with the principles of the present invention. In the present invention, the hot start condition is recognized from the coolant temperature and from the intake air temperature in the engine. The outputs of sensors used for generating a coolant temperature signal and an intake air temperature signal are monitored by a motor control system. These sensors, which are already present in vehicles having motor control devices, in the inventive method, are also used for assisting a hot start. Therefore, there is no additional outlay because no additional sensors are needed.

According to the invention, the motor control system for monitoring these signals remains on after the internal combustion engine has been turned off, i.e., during post-operation time.

The post-operation time is selected so that the internal combustion engine has cooled to such an extent after operation that it would be impossible for a hot start condition to be present.

The motor control system recognizes a hot start condition when the coolant temperature signal and the intake air temperature signal have both reached their respective predetermined limit value at least once during the post-operation time. The formation of vapor bubbles in the fuel can be recognized without directly measuring the temperature of the fuel. This is accomplished by monitoring the coolant temperature and the intake air temperature as described above.

After an internal combustion engine has been turned off, the coolant temperature rises due to the coolant ceasing to circulate and the hot engine. Typically, the coolant temperature increases quickly to a maximum value, then decreases slowly. Due to the hot motor, the intake air temperature after shut-off also rises to a noticeably higher maximum value, but does not normally reach this maximum value at the same time the coolant temperature reaches its maximum value. In every internal combustion engine, there is a direct relationship between the appearance of vapor bubbles in the fuel and the value of the temperatures of the coolant and of the intake air. When formation of the vapor bubbles occurs in the fuel, after the internal combustion engine is shut off, both the coolant temperature and the intake air temperature have each reached their respective maximum values at least once. These maximum values can be determined by trials using different types of internal combustion engines. The two maximum temperature values need not both be reached at the same time. Therefore, it is sufficient that the two maximum limit values are reached at different points in time. When both maximum temperatures are reached, it can be assumed that vapor bubbles have formed in the fuel during the post-operation time.

At this time, the motor control system stores a hot start identifier and is then shut off. The hot start identifier remains stored in the memory of the motor control system.

At the next start of the internal combustion engine, the stored hot start identifier indicates at what temperatures of the coolant and intake air, vapor bubbles will occur in the fuel. A new measurement of the coolant is then taken so the motor control system can determine whether the hot start condition still exists. When the coolant temperature lies above a second limit value, vapor bubbles are still present in the fuel and the motor control system conducts a hot start with an increased quantity of injected fuel.

This second limit value for the coolant temperature is lower than the first for the recognition of the hot start condition. The reason is that vapor bubbles in the fuel, once they have occurred, continue to exist in the cooling engine until the second, lower limit value has been reached. This second limit value has also been identified by trials.

DETAILED DESCRIPTION OF THE PREFERRED EMBODIMENTS

An internal combustion engine is equipped with a motor control system for controlling the quantity of fuel injected. The motor control system interprets information such as the rpm, load, etc., of the internal combustion engine and from this information or characteristics field determines the required quantity of fuel to be injected. For starting the internal combustion engine, another characteristics field for a hot start is generated that triggers an increased quantity of injected fuel in comparison to the normal characteristics field.

Figure 2:
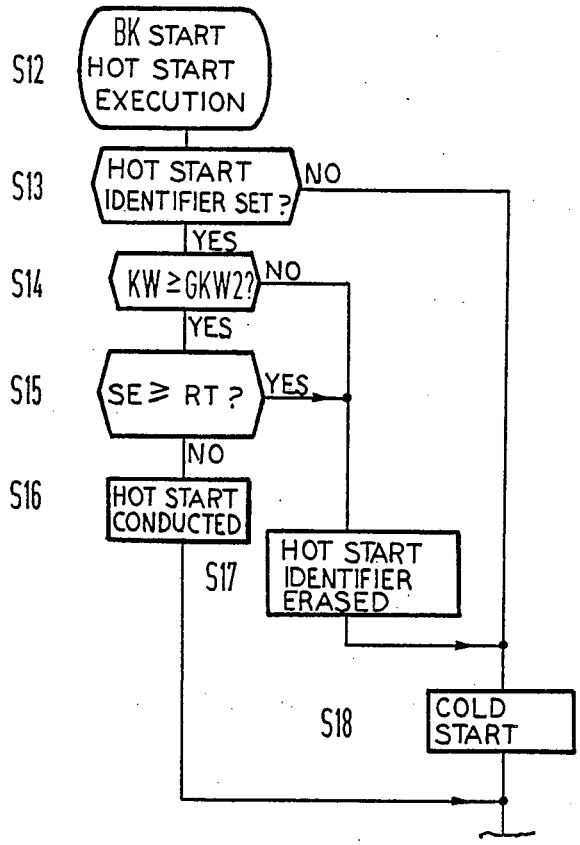
FIG. 2 is a flow chart for deciding whether to execute a hot start when starting the internal combustion engine.

The decision whether such a hot start should be executed is made on the basis of the flow chart of the inventive method set forth in FIG. 2. To make this decision, corresponding program routines are executed in the motor control means.

The following signals are received by the motor control system to be used as input variables for the program routines: a coolant temperature signal KW from a coolant temperature sensor, an intake air temperature signal AL from an intake air temperature sensor, as well as a signal from an ignition switch of the internal combustion engine that indicates whether the internal combustion engine is off or is in the process of being started.

Figure 1:
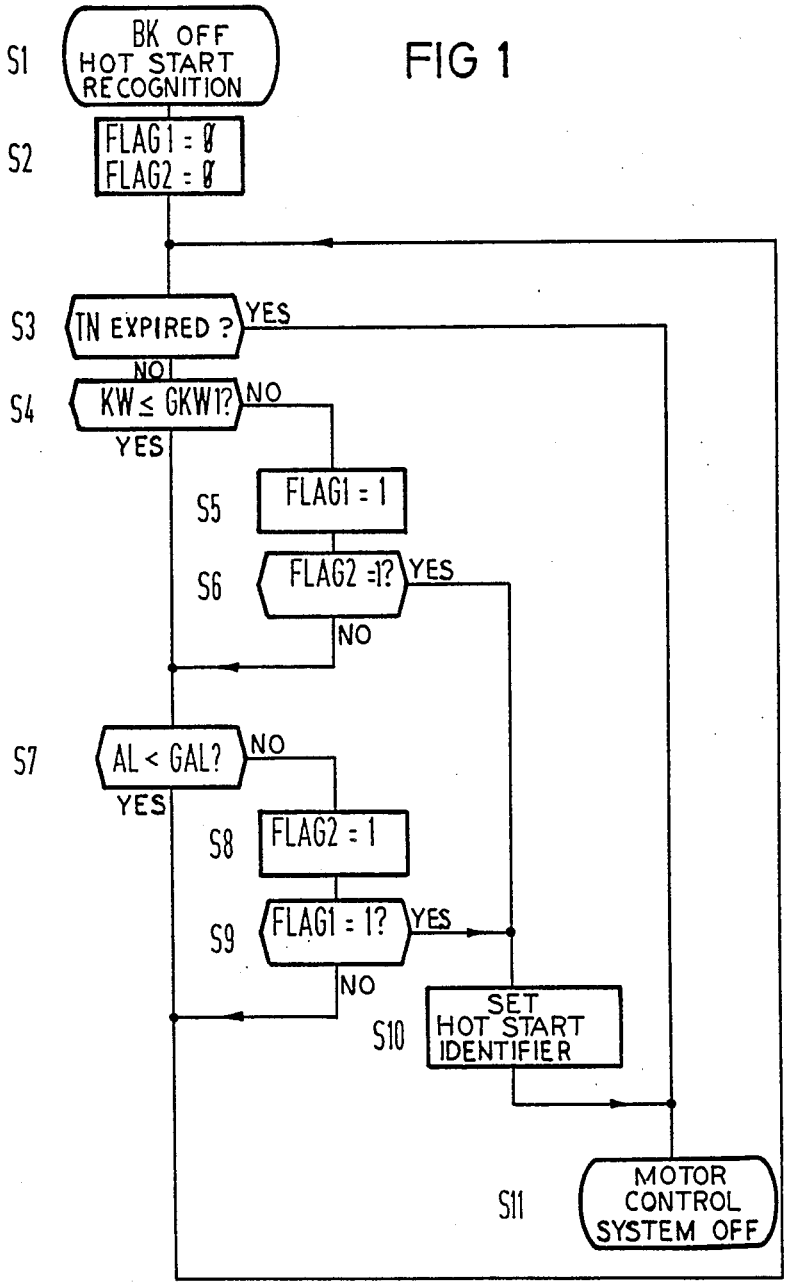
FIG. 1 is a flow chart for the formation of a hot start identifier.

Every time the internal combustion engine is shut off, the motor control means executes a program routine according to the flow chart in FIG. 1 which includes steps S1 through S11.

In step S1, after the arrival of the signal from the ignition switch BK that the internal combustion engine is off, a program for recognizing a hot start condition is started.

In step S2, a flag 1 and a flag 2 are then set equal to zero.

A check is conducted in step S3 whether a post-operating time TN has expired since the internal combustion engine was shut off. This post-operating time TN equals 30 minutes. This value is determined (from trials) and is selected such that a hot start condition cannot occur after the expiration of this time in the internal combustion engine. Since the postoperation time TN begins at the first program run, the answer in step S3 is "no," so step S4 follows. A check is thereby undertaken as to whether a coolant temperature signal KW is lower than a predetermined limit value GKW1. When the answer is "yes," then the interrogation follows to step S7 to determine whether an intake air temperature signal AL is lower than a predetermined limit value GAL.

The maximum limit values GKW1 and GAL are experimentally determined to be GKW1=135° C. and GAW=75° C. for a specific internal combustion engine. These limit values are different for each type of internal combustion engine. When both values are respectively reached or exceeded at least once during the post-operation time TN, this means that vapor bubbles have appeared in the fuel.

As long as the values have not been met, step S7 is again followed by step S3 until the post-operation time TN has expired. The answer in step S3 is then "yes" and the motor control system is turned off in step S11 without a hot start identifier having been stored.

These steps S5, 6, 8, and 9 then serve the purpose of setting the hot start identifier in step S10 when the limit values GKW1 and GAL were respectively exceeded once. When the limit value GKW1 is reached, thus, the answer in step S4 will be "no" and the flag 1 will be set equal to one in step S5. Step S6 then serves to ask whether the flag 2 is likewise equal to 1. This is only the case when the limit value GAL in steps S7 was already exceeded once and, accordingly, flag 2 was set equal to 1 in step S8. When the answer in step S6 is "yes," consequently, the hot start identifier is set in step S10 and stored. These steps S8 and S9 represent the same procedure for the limit value GAL as the steps S5 and S6 represent for the limit value GKW1.

When the motor control system is turned off in step S11, two situations are possible.

The first possible situation is that the post-operation time TN has expired without a hot start condition having been recognized or hot start identifier set.

The second possible situation is that a hot start condition was recognized during the post-operation time TN and hot start identifier set.

At the next start of the internal combustion engine, the program routine of steps S12 through S18 described in the flow chart of FIG. 2 is then executed. A decision is made as to whether a hot start with an increased quantity of injected fuel is required or whether a cold start with the normal quantity of injected fuel is to be carried out.

The program routine for the hot start decision begins with the arrival of the signal from the ignition switch BK indicating that the internal combustion engine is being started.

A check is carried out in step S13 to see whether the hot start identifier is set. When not set, a cold start in step S18 can follow immediately since no hot start condition had been present.

When, in contrast, the hot start identifier is set, step S14 follows with the question of whether the coolant temperature signal KW is higher than a limit value GKW2 of 80° C. When the answer is "no," this means that the hot start condition had, in fact, occurred once but is now no longer present. Accordingly, the hot start identifier is erased in step S17 and step S18 again follows.

When, in contrast, the answer in step S14 is "yes," then the hot start condition continues to exist and the hot start is carried our in step S16.

The normal motor running routine, not shown in FIG. 2, then follows after the hot start in step S16 or after the cold start in step S18.

The step S15 is included for when the starting procedure is interrupted one or more times. In this situation, a hot start was then already carried out for the duration of these starting attempts and an increased quantity of injected fuel was supplied. The intake section of the internal combustion engine is already sufficiently flooded with fuel, so a hot start need not be carried out again.

In step S15, the time elapsed from the beginning of a starting event or the total time for a number of starting events SE is compared to a re-starting time RT. This re-starting time RT amounts to 30 seconds. Given a "yes" answer in step S15, the hot start identifier is then erased in step S17 and the cold start is conducted in step S18. Given a "no" answer in step S15, in contrast, the hot start follows in step S16.

Although modifications and changes may be suggested by those skilled in the art, it is the intention of the inventors to embody within the patent warranted hereon, all changes and modifications as reasonably and properly come within the contribution to the art.

We claim as our invention:

1. A method for conducting a hot start in an internal combustion engine having a motor control system that increases a quantity of fuel injected into said engine during said hot start, said method comprising the steps of:

monitoring a coolant temperature and an intake air temperature of said engine during a post-operation time occurring after said engine is turned off;

recognizing a hot start condition when said coolant temperature and said intake temperature have both reached respective predetermined limit values, each at least once during said post-operation time;

storing a hot start identifier when said hot start condition is present; and executing a hot start in succeeding starts of said engine when said coolant temperature is equal to or greater than a second predetermined limit value, and the hot start identified is stored.

2. A method for conducting a hot start in an internal combustion engine as claimed in claim 1, said method further comprising the steps of:

erasing said hot start identifier when an aggregate restarting time of one or more previous hot starts has elasped or when a predetermined number of revolutions in said engine has occurred after said start.

3. A method for conducting a hot start in an internal combustion engine as claimed in claim 2, the step of erasing is further defined by:

said aggregate restarting time of one or more previous hot starts being 30 seconds.

4. A method for conducting a hot start in an internal combustion engine as claimed in claim 1, said method further comprising the step of:

executing a cold start when said hot start condition is not present.

5. A method for conducting a hot start in an internal combustion engine as claimed in claim 1, the step of monitoring is further defined by:

monitoring a coolant temperature and an intake air temperature of said engine during a post-operation time of 30 minutes after said engine is turned off.

6. A method for conducting a hot start in an internal combustion engine as claimed in claim 1, the step of recognizing is further defined by:

recognizing a hot start condition when said coolant temperature reaches 135° C. and said intake air temperature reaches 75° C.

7. A method for conducting a hot start in an internal combustion engine as claimed in claim 1, said method further comprising the step of:

receiving an ignition switch signal to initiate a determination of whether a hot start condition is present.

* * * * *